United States Patent [19]

Hodges

[11] Patent Number: 4,922,685

[45] Date of Patent: May 8, 1990

[54] PANTIHOSE PACKAGING AND MANUFACTURE

[75] Inventor: Michael J. Hodges, High Wycombe, England

[73] Assignee: Detexomat Machinery Limited, High Wycombe, England

[21] Appl. No.: 285,120

[22] Filed: Dec. 16, 1988

Related U.S. Application Data

[63] Continuation of Ser. No. 73,017, Jul. 14, 1987, abandoned.

[30] Foreign Application Priority Data

Sep. 11, 1986 [GB] United Kingdom ..... 8621957

[51] Int. Cl.[5] ..... B65B 15/00; B65B 25/20

[52] U.S. Cl. ..... 53/429; 53/255; 53/117; 53/581; 223/75

[58] Field of Search ..... 53/581, 156, 117, 429, 53/260, 255; 223/75, 39, 41

[56] References Cited

U.S. PATENT DOCUMENTS

| | | | |
|---|---|---|---|
| Re. 32,481 | 8/1987 | Hodges | 223/75 |
| 2,870,589 | 1/1959 | Berry . | |
| 2,971,302 | 2/1961 | Berry et al. | 53/581 |
| 2,989,178 | 6/1961 | Parker, Jr. . | |
| 3,097,770 | 7/1963 | Garrou | 223/75 X |
| 3,099,353 | 7/1963 | Berry . | |
| 3,166,223 | 1/1965 | Gazzaniga . | |
| 3,209,511 | 10/1965 | Fournier | 53/581 X |
| 3,486,471 | 12/1969 | DeSpain . | |
| 3,520,262 | 7/1970 | Bolles et al. . | |
| 3,826,062 | 7/1974 | Lewis et al. | 53/255 |
| 4,379,384 | 4/1983 | Nishikawa | 53/156 X |
| 4,440,329 | 4/1984 | Hodges . | |
| 4,550,868 | 11/1985 | Hodges et al. . | |
| 4,564,133 | 1/1986 | Gazzarrini | 223/75 X |
| 4,674,663 | 6/1987 | Hurlebaus et al. . | |

FOREIGN PATENT DOCUMENTS

| | | | |
|---|---|---|---|
| 493489 | 8/1977 | Australia | 53/117 |
| 2168089 | 6/1986 | United Kingdom . | |

*Primary Examiner*—James F. Coan
*Attorney, Agent, or Firm*—Dority & Manning

[57] ABSTRACT

Pantihose garments are mounted on a card for purpose of display or sale, the card being inserted into one leg of the pantihose and parts of the pantihose unsupported by the card are folded and disposed to one side of the card-supported part of the leg. Exemplary machinery for so assembling the pantihose and card comprises a boarding machine which has a flat support with two support limbs for the pantihose legs; a dispenser places a card on one of the limbs and the pantihose is pulled waistband first onto the support and thereafter is pulled from the support toes first; the card slips from the limb as the pantihose is pulled off the support and is retained inside the pantihose leg which is stretched flat upon the card therein. Subsequently the pantihose is folded as aforesaid.

29 Claims, 3 Drawing Sheets

PANTIHOSE PACKAGING AND MANUFACTURE

This is a continuation of application Ser. No. 07/073,017, filed July 14, 1987.

The present invention relates to improvements in pantihose packaging and manufacture.

There is a desire to present hosiery at point of sale in packaging which permits ready inspection of the hosiery, at least visually, by prospective purchasers. In some cases too, it may be desired that the hosiery is packaged so the prospective purchaser can feel the quality of the hosiery. More particularly, but not exclusively, these desires apply to patterned hosiery, for instance where the pattern in a single-colour hose is created by an appropriate manipulation of the knitting process.

It is known to mount finished socks individually on suitably stiff moulded plastics formers. Ordinarily, each sock is pulled onto its respective former by hand. This slow, laborious process is clearly unsatisfactory in an industry where production rates may be of the order of some hundreds of dozens of pairs of hose per working shift. There is, also, a substantial risk of damaging otherwise perfect hose while mounting them on their formers. Further, this process is not ideally suited for the packaging of pantihose.

An object of this invention is to devise an improved method of packaging and manufacturing pantihose which can minimise labour-intensive, manual operations and which are well suited to implementation by various hosiery manufacturing machines.

According to the present invention, there is provided a pantihose garment packaged for sale, wherein a former inserted inside one of the legs of the pantihose maintains at least a portion of that leg stretched flat thereon, and the remainder of the garment is placed behind the portion of the leg containing the former so that a layer of the leg is exposed to view, stretched flat and backed by the former. The former may be a card or like board stiff enough to keep the said leg stretched flat. The former inside the said leg can be long enough to be folded in two, when the remainder of the garment is disposed between the two parts of the folded former within the said leg. The garment can be enveloped by a wrapper, e.g. inside a transparent wrapping to protect it from damage before sale.

Supporting formers could be placed inside a portion of each leg of a pantihose garment, and the remaining parts of the garment will be sandwiched between the former-supported portions.

Also according to the present invention, there is provided a method of packaging a pantihose garment which involves use of a flat support having a pair of elongate limbs which extend side by side, a former is laid on one limb, the garment is drawn over the support so its legs are stretched over the respective limbs and so that the former is located inside one of the stretched legs, the garment is thereafter dismounted from the support with the former entrapped within the said one leg and maintaining at least a portion thereof in a stretched flat state, and the remainder of the garment is disposed to one side of the portion of the leg containing the former.

Before the garment is mounted on the flat support, it may be in an inside-out state, and so preferably, it is everted to a right side out state in the course of mounting it on the flat support, so that when later dismounted therefrom it is right side out.

The method according to the invention can be readily integrated with other hose processing operations such as line closing, toe closing and gusset insertion, as will be described hereafter.

When performing the present method, the garment can be boarded and indeed the flat support can be part of a hosiery boarding machine.

The invention has for another of its objects the provision of apparatus for performing the method as hereinbefore defined. Accordingly, the present invention provides apparatus for performing the said method, comprising a hosiery processing e.g. boarding machine having a flat support including a pair of elongate limbs that extend side by side, means to dispense a former onto at least one of the limbs, a loading mechanism to mount a pantihose garment body first onto the support such that the legs of the garment are drawn onto the respective limbs and over the or each former laid thereon, means to dismount the garment such that the or each former is entrapped with the or each leg as the garment is dismounted, and means for disposing portions of the dismounted garment unsupported by the or a former to one side of a portion internally supported by the former.

In one embodiment of the invention, the apparatus includes a second hosiery processing machine having support means for pantihose articles to be processed thereby, the support means and flat support being juxtaposed while the loading mechanism is operable between them (a) to strip a pantihose from the support means, (b) to convey the pantihose towards the flat support and (c) to mount the pantihose thereon. Usually, the flat former will be juxtaposed with the said support means such that former and support means are aligned end-to-end, ends adjacent. The garment is stripped in a forward direction from the support means across to the adjacent former and is drawn with eversion thereof onto the former.

The second machine can, for instance, be a toe closer or gusset inserting machine.

One preferred embodiment of the invention is a hosiery finishing and packaging machine comprising, in combination, a boarding machine, a toe closer including two supports for the legs of pantihose to be toe closed, and a transfer, conveying and loading mechanism operable to strip the pantihose from the toe closer, to convey it to the flat former and to place it, with eversion, in an encircling relationship on the flat former, the said mechanism being movable between operatively-juxtaposed supports of the toe closer and the flat former and having a hose engaging element which is positioned and operative to engage a waistband area of the pantihose on the said supports.

Apparatus according to the invention can form part of an integrated, extensively-automated hosiery processing apparatus comprising e.g. three or four separate processing machines having automatic transfer devices for delivering processed articles from one machine to another.

The various aspects of the present invention will now be described in more detail by way of non-limitative example with reference to the accompanying drawings, in which:

FIG. 1 diagrammatically illustrates a first pantihose package and steps involved in its formation;

FIG. 2 diagrammatically illustrates a second pantihose package and steps involved in its formation;

FIG. 3 diagrammatically illustrates a third pantihose package and steps involved in its formation;

FIG. 4 diagrammatically illustrates one embodiment of apparatus according to the invention in a first operational phase;

Figure 1:
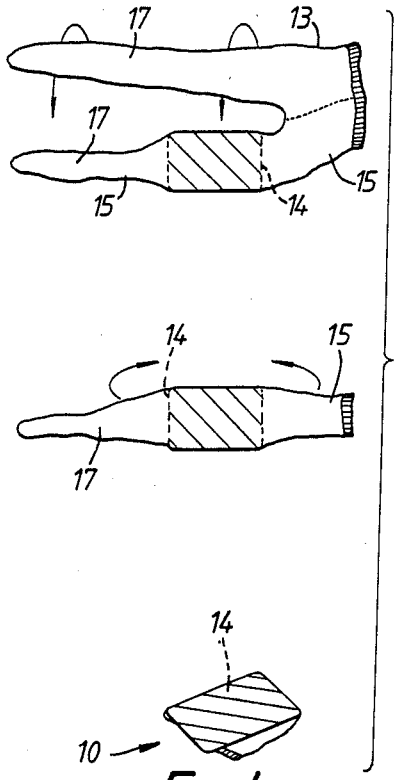
Figure 2:
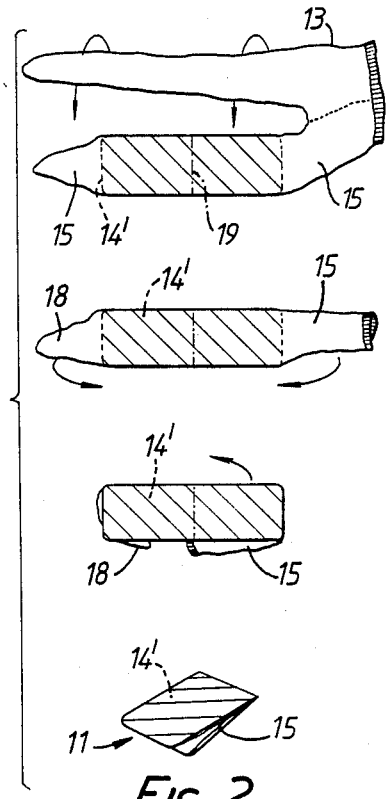
Figure 3:
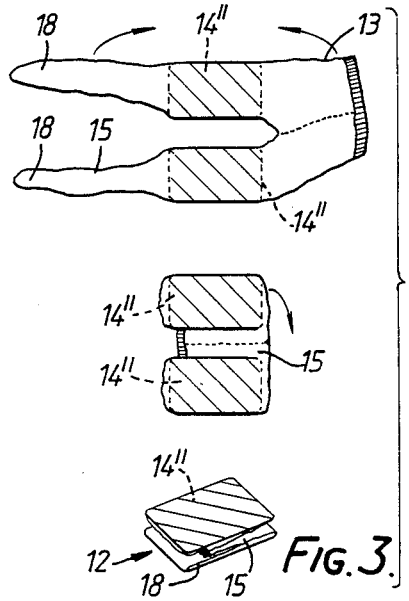

FIGS. 1 to 3 illustrate three forms of pantihose package 10, 11 and 12 according to the invention. The packages 10–12 may be completed for distribution to points of sale by enclosing them in suitable wrappers (not shown) made wholly or partly of transparent material so that prospective purchasers can readily inspect the wrapped pantihose.

A first step in the production of the packages is the insertion of at least one former e.g. a piece of card into the garment 13. The former-insertion step is described hereinafter. The or each former 14 is wide enough, and stiff enough, to keep at least part of a leg 15 of the garment stretched flat so that in the completed package, a layer of fabric is displayed, against a backing comprising the former 14, so as to be readily discernable by visual inspection.

The package 10 is produced as follows. A former 14 is first arranged inside one leg 15 of the garment 13 at any convenient location therealong. As shown, the former occupies a thigh portion of the leg 15. The garment is then folded in half lengthwise, placing one leg over or under the other leg; the garment body 16 is folded, therefore. Next, the leg portions 17 unsupported by the former are folded under the leg portion supported by the former; the already once-folded body 15 is also folded under the leg portion supported by the former 14. In the result, the bulk of the garment is disposed to one side of the former 14 and a single layer of one leg is presented to view backed by the former inside in that leg.

Package 11 is similar to package 10 except that the single former 14′ is longer than previously; this former is about twice as long as former 14 and hence occupies a thigh and calf portion of leg 15. After folding the garment in half lengthwise, and after folding over or under the unsupported foot 18 and body 15, the former 14′ is folded in half so as to embrace the unsupported hose portions therebetween. Package 11 reminiscent of a book thus results. Former 14′ can have a transverse crease 19, or the like to assist folding.

Package 12 is even more similar to package 10 except that two formers 14″ are used. One former is located in each leg 15. In this case, the formers 14″ are substantially identical to the former 14 of FIG. 1 and are similarly located in their respective legs 15. The package 12 is produced by folding the unsupported leg portions 18 over the associated portions supported by the formers 14″; the garment body is then folded so as to overlie the two leg portions supported by the formers 14″. Lastly, the body 15 is folded lengthwise, thereby to place one supported leg portion over the other with the unsupported portions of the garment being located therebetween.

Arrows shown in FIGS. 1 to 3 indicate the ways in which the garments 13 are folded.

To avoid damaging the garments 13, the formers should have smooth edges and rounded corners.

Conceivably, a pantihose garment could be mounted on a large former, shaped to correspond to the garment when the latter is laid out in a stretched flat state, the former being folded several times to produce a package of relatively small compass. Such an arrangement is not considered of great merit, however. For one thing, a large former would entail unnecessarily large packaging costs and for another would result in an undesirably thick package.

Various mechanical contrivances and/or arrangements of air jets can be employed for folding the unsupported portions of the garment 13 as described hereinabove. Such mechanical and pneumatic contrivances have already been developed e.g. for folding paper goods or garments automatically for packaging. It is believed that such contrivances can readily be adapted or devised by the skilled workman to whom this specification is addressed, and hence a description thereof is omitted. Design of folding contrivances will be a routine excecise having regard for the manner of folding described fully hereinbefore.

Of course, the folding operations could be performed manually if desired.

Figure 4:
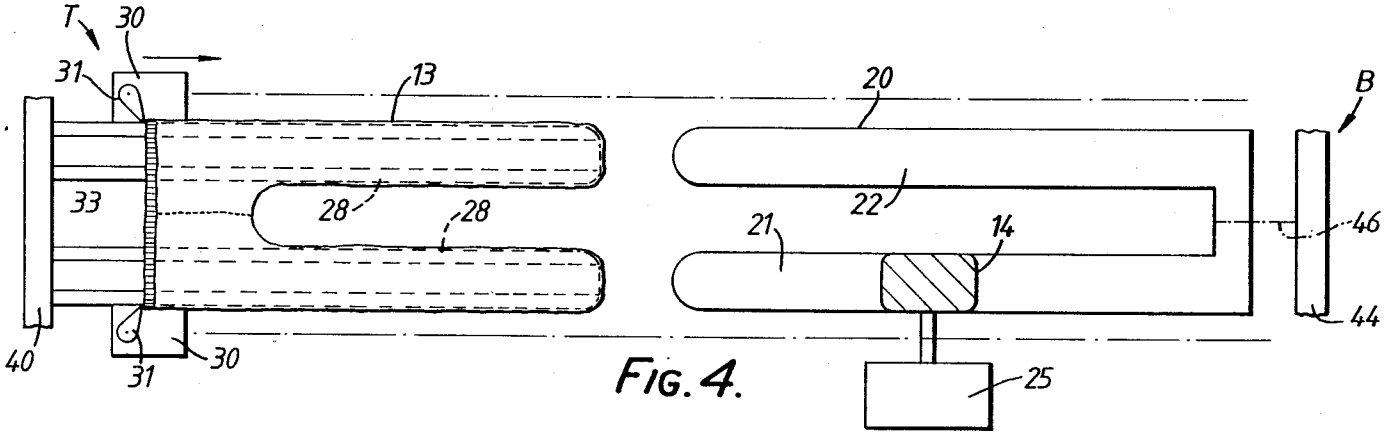
Figure 5:
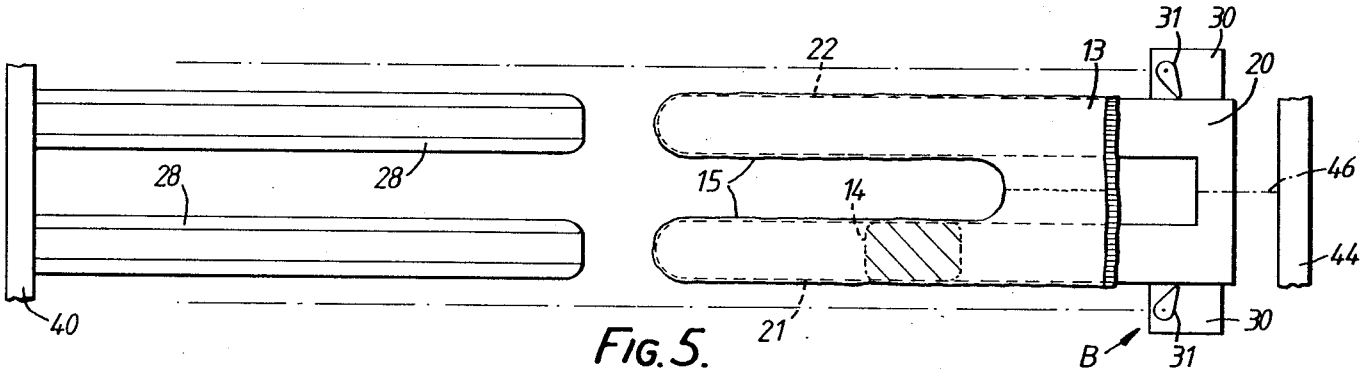
FIG. 5 shows the apparatus of FIG. 4 in a second operational phase.

Insertion of the former or formers will now be described with reference to FIGS. 4 and 5. Most conveniently, the insertion is accomplished using a boarding machine B or similar. Machine B has a flat support 20 including two elongate limbs 21, 22 disposed side by side and spaced apart sufficiently to stretch the garment body 15 laterally out flat when drawn onto the support 20. The limbs 21, 22 each have a width large enough to stretch the garment legs 15.

Associated with the support 20 is a former supply device 25 which deposits one or more formers as required onto one or both limbs 21, 22. The support 20 can be adapted to hold a former or formers laid thereon temporarily in place, e.g. by means of suction, clips or otherwise.

Having placed a former 14 or formers on the limbs 21, 22, the garment 13 is drawn over the support 20 such that the latter enters the garment. The garment 13 is drawn onto the support 20 waistband end first; it is so oriented that its legs 15 are each drawn over a respective limb 21, 22. As the garment is drawn over the support 20 and former(s), the latter is or are effectively inserted into one or both legs.

Conveniently, the garment 13 is loaded onto the flat support 20 of machine B by an automatic device which, as illustrated, serves as a transfer mechanism (M) for conveying the garment from the supports 28 of a toe closing machine T. The transfer device (M) comprises, by way of example, a movable carriage 30 having hose engaging elements 31. Elements 31 are positioned for engaging the waisband 33 of garment 13 on the toe closer. The carriage 30 is guided for movement along a path extending along the operatively juxtaposed toe closer supports 28 and flat support 20 of the machine B. The path of movement of carriage 30 is shown chain-dotted in FIGS. 4 and 5 and its direction of movement during transfer is shown by the arrow in FIG. 4.

During transfer, the elements engage e.g. grip the waistband 33 and as the carriage moves, they move therewith to strip the garment body forwardly off the toe closer supports 28 and then to draw it rearwardly onto the flat support 20. While the garment 13 is being stripped by the forward movement of the waistband along the toe closer supports 28, suction may be created in the supports 28 to draw the legs into the supports.

When the garment 13 has been drawn fully onto the flat support 20, the engaging elements 31 automatically disengage from the waistband.

Thereafter, the carriage 30 can be returned to its starting position at the toe closer by a suitable reversible carriage drive means, not shown.

During the transfer and loading operation, the garment is everted and mounted on the flat support 20 in a right side out state.

The supports 20 and 28 are operatively juxtaposed substantially in line with their ends adjacent one another. If the toe closer supports 28 are mounted on a rotary turret 40, they enter appropriate juxtaposition with the flat support 28 when the turret 40 rotates bringing them to a discharge station of the toe closer.

The flat support 20 can also be mounted on a rotary support or turret 44 of machine B. The support 20 is operatively juxtaposed with supports 28 when turret 44 moves it into a loading station of machine B.

After the garment has been mounted on the support 20, the latter may be hinged by actuating means Ⓐ about a central longitudinal axis 46 therethrough thereby placing one limb closely adjacent the other and in face-to-face relationship therewith. Such a hinging movement effects a folding of the garment lengthwise, as described above with reference to FIGS. 1 and 2. The actuating means Ⓐ can comprise driven gears, cams or levers driven e.g. by an electric, pneumatic or hydraulic actuator such as a motor or ram. The design of such actuating means is well within the ability of an engineer familiar with hosiery machinery and hence a detailed description here is considered superfluous.

Such a hinging movement can be omitted, however, and will be omitted if a package 12 according to FIG. 3 is to be formed.

The mounted garment 13 is then dismounted feet first from the flat support 20. Thanks to tension in the laterally stretched legs 15 and minimal friction between the support 20 and the or each former, the latter slips off the support 20 with the garment. Accordingly, when the garment has been dismounted, the or each former is trapped within an associated leg of the garment which can then be folded as described with reference to FIGS. 1 to 3.

Dismounting of the garment can be accomplished by engaging suitable gripping means, not shown, with the toe ends of the garment and by effecting a relative longitudinal movement between the gripping means and the flat support.

The gripping means could, for example, be a pair of counter-rotating rollers adapted to exert a pressing or flattening action on the garment.

While the garment 13 is mounted on the flat support 20, it can be boarded or heat set, if desired, for which purpose the support is provided with electrical or other heating means.

The garment 13 can be passed between a pair of rollers to press and flatten it when dismounted from the flat support, that is to say after it is dismounted therefrom or in the course of dismounting it in which latter case the rollers can be the means which effect dismounting.

In essence, the combination of a toe closer and boarding machine is known from our European Patent No. 57 055 and U.S. Pat. No. 4,434,918 which are incorporated herein by this reference and to which reference is hereby directed for further details.

Figure 6:
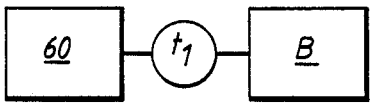
FIGS. 6 to 8 are block diagrams schematically illustrating hosiery processing equipment which embody the present invention.

It is not essential for machine B to be associated with any other hosiery processing machine. However in the interest of high productivity, machine B is preferably associated with another machine for instance as shown in FIG. 6, where 60 represents the other machine and $t_1$ represents an automatic transfer and loading device. Machine 60 can be a line closer or gusset inserting machine instead of a toe closer as particularly described hereinbefore.

Figure 7:
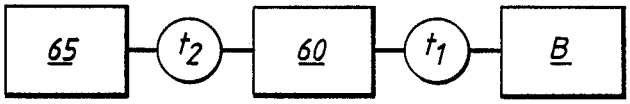
Figure 8:
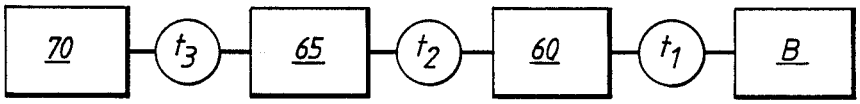

Machine B can be part of a more complex hosiery processing installation, comprising in addition to machine B, a plurality of other machines interlinked by respective transfer and loading devices. See FIG. 7, where the installation comprises in toto three separate machines B, 60 and 65 with transfer devices $t_1$, $t_2$. See also FIG. 8, where the installation by way of example comprises four separate machines B, 60, 65, 70 and transfer devices $t_1$, $t_2$ and $t_3$. Machines B, 60, 65 and 70 will be different machines in the sense that each machine performs a hosiery processing function different to all the other associated machines. Machines 60, 65 and 70 can be any combination of two or three of the following machines, namely a line closer, a toe closer and a gusset insertion machine and the order in which the machines are assembled in the installation can be varied as desired. It is not essential, for the machine linked to machine B to be a toe closer, for instance.

The foregoing description with reference to the drawings speaks of "folding" the garment. This word should not be interpreted narrowly, implying precision in location or arrangement of folds, and is to be understood to mean that layers of fabric are doubled one upon another in any convenient way to place parts of the garment to one side of a former-supported portion thereof. The placement of the said parts relative to the former-supported portion could even involve an irregular crumpling of the said parts without unduly harming the garment.

I claim:

1. A method of packaging a hosiery article comprising a pantihose garment which involves use of a flat support having a pair of elongate limbs which extend side by side, a former is laid on one limb, the garment is drawn onto the support stretching its legs over the respective limbs of said support whereby said former is located inside one of the stretched legs, the garment is thereafter dismounted from the support with said former entrapped within said one leg whereby said former maintains at least a portion of said one leg in a stretched flat state, and the remainder of the garment is disposed to one side of the portion of said leg containing the former.

2. A method according to claim 1, wherein before dismounting the garment, the two limbs with the garment thereon are moved into a face-to-face disposition thereby doubling a body part of the garment and placing the legs one over the other.

3. A method according to claim 1, wherein before said garment is drawn onto said flat support, it is mounted with its legs supported internally on a pair of hose carriers of a toe closing machine, toe closing seams are formed across toe ends of said legs, said carriers and said flat support are brought into operative juxtaposition and automatic transfer means is actiavted to strip said garment off said carriers and draw it at least partially onto the flat support.

4. A method according to claim 2, wherein before said garment is drawn onto said flat support, it is mounted with its legs supported internally on a pair of hose carriers of a toe closing machine, toe closing seams are formed across toe ends of said legs, said carriers and said flat support are brought into operative juxtaposition and automatic transfer means is actiavted to strip said garment off said carriers and draw it at least partially onto the flat support.

5. A method according to claim 1, wherein said flat support is heated to board or heat set the garment.

6. A method according to claim 1, wherein the garment is passed between a pair of rollers to press and flatten it, when dismounted from the flat support.

7. A method according to claim 2, wherein before said article is drawn onto said flat support it is mounted on a carrier of a hose processing machine which is operated to perform a preliminary hose processing operation, said carrier and said flat support are brought into operative juxtaposition and automatic transfer means is activated to strip said article from the carrier and to draw it onto said flat support.

8. A method according to claim 1 or claim 2, wherein the former and said leg portion containing it are folded in two, and the remainder of the garment is confined between the two parts of the folded former and leg portion containing it.

9. A method according to claim 1 or claim 2, wherein like formers for both legs are laid on both limbs and the garment is subsequently dismounted with a former entrapped inside at least a portion of each leg whereby respective leg portions are maintained in stretched flat states, and thereafter the remainder of the garment is sandwiched between said portions embracing their respective formers.

10. A method according to claim 6, wherein the garment is initially in an inside-out state and is everted to a right side out state while mounting it on said flat support.

11. A method according to claim 1, wherein before said article is drawn onto said flat support it is mounted on a carrier of a hose processing machine which is operated to perform a preliminary hose processing operation, said carrier and said flat support are brought into operative juxtaposition and automatic transfer means is activated to strip said article from the carrier and to draw it onto said flat support.

12. A method according to claim 8, wherein before said garment is drawn onto said flat support, it is mounted with its legs supported internally on a pair of hose carriers of a toe closing machine, toe closing seams are formed across toe ends of said legs, said carriers and said flat support are brought into operative juxtaposition and automatic transfer means is actiavted to strip said garment off said carriers and draw it at least partially onto the flat support.

13. A method according to claim 8, wherein before said article is drawn onto said flat support it is mounted on a carrier of a hose processing machine which is operated to perform a preliminary hose processing operation, said carrier and said flat support are brought into operative juxtaposition and automatic transfer means is activated to strip said article from the carrier and to draw it onto said flat support.

14. A method according to claim 9, wherein before said article is drawn onto said flat support it is mounted on a carrier of a hose processing machine which is operated to perform a preliminary hose processing operation, said carrier and said flat support are brought into operative juxtaposition and automatic transfer means is activated to strip said article from the carrier and to draw it onto said flat support.

15. A method according to claim 10, wherein before said article is drawn onto said flat support it is mounted on a carrier of a hose processing machine which is operated to perform a preliminary hose processing operation, said carrier and said flat support are brought into operative juxtaposition and automatic transfer means is activated to strip said article from the carrier and to draw it onto said flat support.

16. A method according to claim 11, wherein said processing operation comprises joining two separate hose legs together to form a unitary pantihose garment.

17. A method according to claim 11, wherein said processing operation comprises insertion and seaming of a gusset into the crutch of a pantihose garment.

18. A method according to claim 9, wherein before said garment is drawn onto said flat support, it is mounted with its legs supported internally on a pair of hose carriers of a toe closing machine, toe closing seams are formed across toe ends of said legs, said carriers and said flat support are brought into operative juxtaposition and automatic transfer means is actiavted to strip said garment off said carriers and draw it at least partially onto the flat support.

19. A method according to claim 10, wherein before said garment is drawn onto said flat support, it is mounted with its legs supported internally on a pair of hose carriers of a toe closing machine, toe closing seams are formed across toe ends of said legs, said carriers and said flat support are brought into operative juxtaposition and automatic transfer means is actiavted to strip said garment off said carriers and draw it at least partially onto the flat support.

20. Apparatus for packaging hosiery comprising:

a hosiery processing machine, said machine having a flat support with a pair of elongated limbs extending side-by-side;

means to dispense a former into at least one of said limbs;

loading means for mounting a pantihose garment onto said flat support such that legs of said garment are drawn onto said limbs and over said at least one former laid thereon;

means to dismount said pantihose garment while entrapping said at least one former within said garment leg; and means for disposing portions of said dismounted garment unsupported by said former to one side of said portion of said garment internally supported by said former.

21. Apparatus according to claim 20, wherein said support is articulated to permit the limbs to be disposed face-to-face and adjacent one another after mounting the garment thereon, for use to fold the garment in half in a lengthwise direction.

22. Apparatus according to claim 20, including a second hosiery processing machine having support means for hosiery articles to be processed thereby, said support means and said flat support being adapted to be juxtaposed while said loading means is operable between them (a) to strip a hosiery article from said support means, (b) to convey said article towards the flat support and (c) to mount said article thereon.

23. Apparatus according to claim 22, wherein said support means and flat support are mounted on their associated machines for movement about respective closed paths into operative juxtaposition with said loading means.

24. Apparatus according to claim 22 or claim 23, wherein the second machine is selected from a line closing machine, a toe closing machine and a gusset inserting machine.

25. Apparatus according to claim 22, wherein in addition to first and second machines respectively incorporating said flat support and said support means, the apparatus includes another hosiery processing machine and a transfer means operable to transfer pantihose articles processed thereby from said other machine to said second machine.

26. Apparatus according to claim 25, wherein said second machine is a toe closer and said other machine is selected from a line closing machine and a gusset inserting machine.

27. Apparatus according to claim 25, wherein said second machine is a gusset inserting machine and the other machine is selected from a toe closing machine and a line closing machine.

28. Apparatus according to claim 25, which includes a further hosiery processing machine and an associated transfer means operable to convey pantihose articles processed thereby from said further machine to said other machine.

29. Apparatus according to claim 28, wherein said second machine, said other machine and said further machine are operable to provide different processing functions and said machines each comprise a different one of a line closer, a toe closer and a gusset inserting machine.

* * * * *